United States Patent [19]

Bullock

[11] 4,084,513

[45] Apr. 18, 1978

[54] RAILROAD CAR SIDE FRAME CONSTRUCTION

[75] Inventor: Robert L. Bullock, Lombard, Ill.

[73] Assignee: Standard Car Truck Company, Chicago, Ill.

[21] Appl. No.: 717,517

[22] Filed: Aug. 25, 1976

Related U.S. Application Data

[63] Continuation-in-part of Ser. No. 590,291, Jun. 25, 1975, abandoned.

[51] Int. Cl.[2] ..... B61F 5/06; B61F 5/12; B61F 5/50; F16F 1/06

[52] U.S. Cl. ..... 105/197 DB; 105/207

[58] Field of Search ..... 105/197 DB, 197 D, 206 R, 105/207; 267/3, 4

[56] References Cited

U.S. PATENT DOCUMENTS

| | | | |
|---|---|---|---|
| Re. 22,867 | 4/1947 | Dath | 105/197 DB |
| 2,547,348 | 11/1951 | Orr et al. | 105/197 DB |
| 2,827,987 | 3/1958 | Williams | 105/197 DB |
| 3,080,828 | 3/1963 | Tack et al. | 105/197 DB |
| 3,408,955 | 11/1968 | Barber | 105/197 DB |
| 3,575,117 | 4/1971 | Tack | 105/197 DB |
| 3,857,341 | 12/1974 | Neumann | 105/197 DB |

*Primary Examiner*—Drayton E. Hoffman
*Assistant Examiner*—Howard Beltran
*Attorney, Agent, or Firm*—Kinzer, Plyer, Dorn & McEachran

[57] ABSTRACT

A railroad truck side frame includes spaced tension and compression members connected by vertical columns. The tension and compression members, as well as the vertical columns, define a window and there is a bolster extending through the window. One side of each vertical column has a widened area, with the opposite side of each vertical column being substantially coplanar with the side frame. The bolster has lugs projecting from both sides thereof on opposite sides of each column, with the space between lugs on each side of the bolster being substantially greater than the width of the side frame and slightly greater than the distance between the outside of the widened area and the opposite side of the vertical column.

1 Claim, 2 Drawing Figures

RAILROAD CAR SIDE FRAME CONSTRUCTION

SUMMARY OF THE INVENTION

This application is a continuation-in-part of my copending application Ser. No. 590,291 filed June 25, 1975, now abandoned.

This invention relates to improvements in stabilized railroad car trucks and has for its principal object an improved side frame which will minimize horizontal rotation or pivotal movement between the bolster and side frame.

Another purpose is a structure of the type described which provides substantial efficiencies and economies in manufacturing the side frame.

Another purpose is a railroad car truck side frame having a widened area on one side of each vertical column to minimize horizontal rotation between the bolster and side frame.

Another purpose is a structure of the type described in which the widened area is on the inboard side of each side frame.

Another purpose is a structure of the type described which reduces the wear between the points of contact of the bolster and side frame during relative rotation therebetween.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
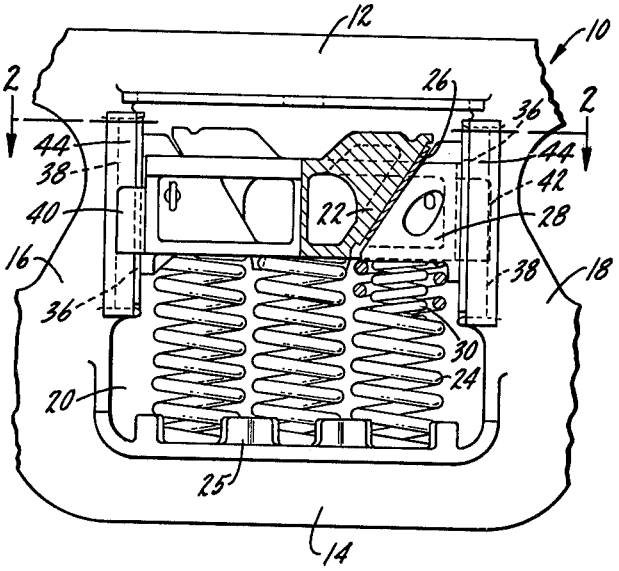
FIG. 1 is a partial side view, in part section, of a railroad car truck side frame with the bolster in place.

The present invention relates particularly to a side frame bolster interlock arrangement adapted to minimize horizontal rotational movement between the bolster and the side frame. There is a prescribed minimum clearance between adjacent surfaces of the side frame column walls and the bolster so that transverse shifting of the bolster on the load springs in a direction longitunal of the truck, and also rotation of the bolster about a vertical axis, is minimized. However, in snubbed trucks there must be sufficient room for the friction shoes to move transversely of the bolster as they are actuated by their springs. When the friction springs are in normal compressed or expanded condition they urge their related friction shoes into snug engagement with the adjacent side frame column surfaces and normally in so doing serve to maintain clearance between the bolster and side frame columns. It has been found that in certain instances where cars have been subjected to unusually severe longitudinal jolts or bumps, for example as the result of humping practices, bolsters have been displaced to such an extent that the friction springs are no longer effective in maintaining proper clearance between the bolster and side frame column surfaces.

Another result of a severe shock imparted to the car is that the truck may tend to continue forward such that rotational movement of the bolster tends to release the forward supporting springs and compress the rear springs. The bolster may thus be jammed against the foward side frame columns and released from the rear side frame columns. With the bolster jammed and tilted against one pair of side frame columns, the friction devices on the side of the bolster adjacent those columns are overcompressed, while the friction devices on the opposite sides of the bolster are overextended. This result can produce abnormal wear patterns on both the friction shoes and the surfaces engaged by the shoes and can decrease the surface life of the shoes.

If the bolster has been jammed against corresponding side frame columns with sufficient force, it can shift laterally on the load supporting springs so that the frictional resistance between the upper surfaces of the load springs and the lower surface of the bolster is too great to permit the bolster to return, or to be urged by the friction springs, to proper position relative to the side frame column.

It is possible that a relatively slight displacement of the bolster and a minor dislodgment of the load springs could occur without being noticed as a car continues in service. Under these conditions snubbing action would still take place as the load taken from the snubbing devices on one side of the bolster would be added to the other. However, uneven or erratic wear patterns would occur and the service life of the parts would be shortened.

Thus, inasmuch as a snubbed truck requires a definite predetermined distance between the side frame columns and the friction shoes and bolster, in order to prevent any erratic or uneven wear patterns on the snubbing surfaces, and to insure optimum service life of the parts, it is desirable to maintain this distance and provide other means for restricting horizontal rotational movement of the bolster within the opening.

The present invention is directed toward preventing pivotal or horizontal rotation of the bolster within the side frame window and is an improvement on the structure shown in U.S. Pat. No. 3,408,955 and is specifically directed to a side frame column structure which is more efficient in manufacture than that shown in said patent. In the above-mentioned patent there are widened surfaces on each side of each vertical column which cause a jamming action between the bolster and the side frame if the bolster should rotate within the side frame. The present invention places a widened surface on only one side of the side frame vertical column, with the other side of the column being substantially coplanar with the remaining portions of the side frame. The widened area on the side frame causes a jamming action with the bolster, if a force should be applied to the car which would tend to cause the bolster to rotate within the side frame window.

In the above-mentioned U.S. Pat. No. 3,408,955 the centerline for rotation of the side frame relative to the bolster is coincident with the point of intersection of the bolster and side frame centerlines. Lines drawn between diagonally opposing points of contact between the bolster and the side frame, when the bolster rotates relative to the side frame, also pass through the centerline of rotation. The forces applied at the four locations where there is wear contact between the bolster and side frame are equal and the force moment arms for each point of contact are equal, i.e., the same distance from the centerline of rotation.

It is known that for both curving and light car stability it is desirable to restrict the relative rotation between the side frame and the bolster. With the advent of high mileage service, for example unit trains, structures of the type shown in the U.S. Pat. No. 3,408,955 have been showing wear in substantial amounts at the above-described bolster and side frame contact points. One cause of the wear is that the steel characteristics of the side frame and bolster, being controlled by the American Association of Railroads, is specifically directed to structural strength, rather than wear characteristics. The present invention, as will be described hereinafter, is specifically directed at reducing the wear at these points of contact, which wear can have the result of permitting greater relative rotation between the bolster and side frame.

In FIG. 1 a side frame member is indicated at 10 and will conventionally have an upper compression member 12 and a lower tension member 14 connected by vertical columns 16 and 18. The combination of the compression member, tension member and vertical columns define a window 20. A bolster 22 is positioned within the window.

Bolster 22 is supported by a plurality of load springs 24 positioned by spring supporting projections 25 on tension member 14.

Figure 2:
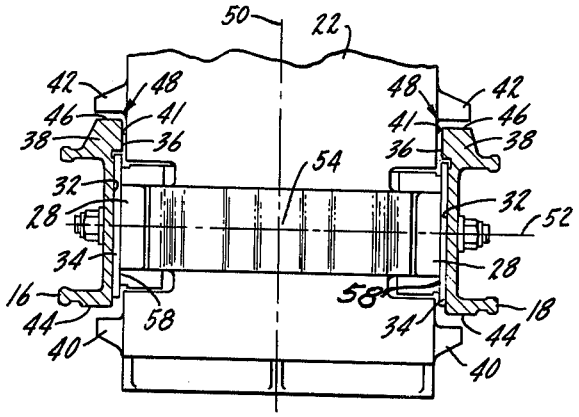
FIG. 2 is a section along plane 2—2 of FIG. 1.

On each side of the bolster is a pocket 26 which will receive a stabilizing wedge 28 supported on a stabilizing spring 30. Looking particularly at FIG. 2, each vertical column has a recess 32 mounting a wear plate 34. Wear plates extend a sufficient lateral distance to always be in contact with stabilizing wedges 28, regardless of the amount the bolster may shift within the window. Directly adjacent the surface of wear plate 34 which opposes the stabilizing wedge is a coplanar surface 36 which is formed by a widened area 38 on the inboard side of each vertical column. Note paticularly that the widened area 38 does not extend the full height of the vertical column, but extends a distance less than the space between the tension and compression members.

Bolster 22, on each side thereof, may be provided with lugs 40 and 42 on the outboard and inboard sides, respectively. The distance between lugs 40 and 42 is subtantially greater than the width of side frame 10, but is just slightly greater than the distance between outboard surface 44 on the side frame column and inner surface 46 of widened area 38. Any attempt on the part of the bolster to rotate within the window of the side frame will cause the bolster and side frame to contact and jam each other generally at the areas, designated by arrows 48 and 58, where the widened area 38 extends into the corner defined by lug 42 and the bolster wall 41 and at opposing edges of wear plate 34 and wedge 28. Thus, relative rotation between the bolster and the side frame is limited by contact at these areas. The American Association of Railroads prescribes predetermined clearances between surface 46 and lug 42 and between surface 44 and lug 40. The gap between the bolster and the coplanar surfaces 36 and the outer surface of wear plate 34 are, however, minimized in the present construction, thus permitting the corner surfaces to contact as described.

Bolster centerline 50 and side frame centerline 52 intersect at what is known as the centerline of rotation designated at 54. The distance between point 54 and the inside points of contact 48, when there is relative rotation between the bolster and the side frame, is greater than the distance between point 54 and contact points 58 where friction wedges 28 contact wear plates 34. Thus, lines drawn between diagonally opposed contact points 48 and 58 intersect the centerline 50 of the bolster at a position inwardly of the centerline of rotation, point 54.

There is a distinct advantage in having relocated the above-described intersection of lines drawn between diagonally opposed contacts, principally in that the moment arm, or the distance between the centerline of rotation 54 and contact points 48 has now been increased over the moment arm between the same points as shown in the U.S. Pat. No. 3,408,955. In addition, the contact points at the outside of the bolster are no longer between structural members, as in the U.S. Pat. No. 3,408,955, but are now between opposed portions of the side frame wear plate and the bolster friction wedge, both of which are specifically designed to have excellent wear properties. Assuming that the forces causing rotation, or the non-squaring forces applied to the truck, are the same as in a truck of the type shown in the U.S. Pat. No. 3,408,955, since the distance between points 54 and 48 is greater than in the U.S. Pat. No. 3,408,955, the actual wear force at points of contact 48 is less than in a structure such as in the U.S. Pat. No. 3,408,955. Thus, wear at points of contact 48 will be reduced where the material properties are designed for structural strength and not for wear. By the same token, although the wear forces applied at points of contact 58 will be increased over those shown in the U.S. Pat. No. 3,408,955, the points of contact have been moved from members not having good wear characteristics to permit contact between members specifically designed to have superior wear characteristics.

In addition, during normal service conditions, as the friction wedges 28 wear, they will rise within their respective pockets. Thus, unworn surfaces of the wedge will become available for preventing the described rotation, thus maintaining the bolster and side frame relative rotation within allowable limits.

In the above-mentioned U.S. Pat. No. 3,408,955, there are widened surfaces on each side of the side frame vertical columns. In practice, it was found to be difficult to cast such side frame surfaces, with the result that the widened areas might be imperfectly cast or formed and thus would not provide the force receiving structure which is necessary to prevent the described relative rotation between the bolster and side frame. By placing a widened area on only one side of the side frame, the side frame may be economically and efficiently cast. Although it is preferred to have the widened area on the inboard side of the side frame, in some situations it may be permissible to place the widened area on the outboard side. In any event, it is important that the widened area or wide land only be on one side of the side frame casting.

Whereas the preferred form of the invention has been shown and described herein, it should be realized that there may be many modifications, substitutions and alterations thereto.

The embodiments of the invention in which an exclusive property or privilege is claimed are defined as follows:

1. In combination, a railroad truck side frame having a window, a bolster extending through said window, said side frame including an upper compression member and a lower tension member, spaced vertical columns extending between and connecting said compression member and tension member and defining the inboard and outboard sides of said window, said bolster having lugs projecting from both sides thereof on opposite sides of said columns, a widened area forming a reinforcing mass on the same side of each vertical column extending away from the side frame on the inboard side, with the opposite side of each column being substantially coplanar with the side frame, the widened area on each vertical column extending a vertical distance less than the distance between said tension member and compression member, the space between lugs on each side of the bolster being substantially greater than the width of said side frame, and being slightly greater than the distance between the outside of said widened area and the opposite side of said vertical column, said lugs being positioned adjacent and extending outside of said widened area and coplanar side, a wear plate on each vertical column facing the bolster, with the surface of each wear plate facing said bolster being substantially coplanar with a surface on said widened area facing said bolster, a pocket in each side of the bolster having a wear plate and a friction member in each pocket opposite its corresponding wear plate, relative rotation between said bolster and side frame causing wear contact at diagonally opposed portions of said bolster and side frame, said diagonally opposed portions being: each widened area reinforcing mass and the opposing bolster area adjacent one of said lugs (48), and between opposing edge portions of each vertical wear plate and its corresponding friction member (58), a line drawn between said diagonally opposed bolster and side frame portions (48 and 58) crossing the bolster center line (50) inboard of the side frame center line (52).

* * * * *